United States Patent [19]

Su

[11] Patent Number: 5,064,069

[45] Date of Patent: Nov. 12, 1991

[54] ACCORDION-LIKE FILE

[76] Inventor: Ken-Jui Su, No. 102, Lane 52, Fu-Te Rd., Shu Wang Tsun, Ta-Li Shiang, Taichung Hsien, Taiwan

[21] Appl. No.: 663,738

[22] Filed: Mar. 4, 1991

[51] Int. Cl.[5] ..... B65D 85/00

[52] U.S. Cl. ..... 206/425; 190/900

[58] Field of Search ..... 206/425; 190/900, 901, 190/902

[56] References Cited

U.S. PATENT DOCUMENTS 329,676 11/1885 Reade ..... 206/425

*Primary Examiner*—William I. Price

*Attorney, Agent, or Firm*—Poms, Smith, Lande & Rose

[57] ABSTRACT

An improved accordion-like file has a plastic cover and envelopes, the plastic cover is integrally formed as a foldable multiple-sectioned cover and folded inward on one end to form a folded piece and a block piece with a foldable mechanism therebetween. By moving the block piece outward and securing to the folded piece with a set of reusable tape thereon, the accordion-like file can be completely extended and contain documents with more space.

3 Claims, 5 Drawing Sheets

ACCORDION-LIKE FILE

BACKGROUND OF THE INVENTION

The present invention relates to files, and more particularly, to plastic accordion-like files.

Conventionally, documents are stored in common files and thereafter pulled out for viewing. Accordion-like files have advantages, such as saving space and being portable off the shelf. The conventional accordion-like files, referring to FIGS. 5 and 6, comprise a cover 5 and envelopes 51. When closed (refer to FIG. 5), the envelopes 51 are enclosed within the cover 5, therefore retaining a portable state. When the file is used (refer to FIG. 6), the envelopes 51 are unfolded and documents can either be pulled or put into the file. The conventional file has advantages such as being portable; however, it still bears several drawbacks, including limited space, repeated folding and unfolding the plastic cover 5 and envelopes 51, and not being able to stand upright.

It is the purpose of this present invention, therefore, to mitigate and/or obviate the above-mentioned drawback in the manner set forth in the detailed description of the preferred embodiment.

SUMMARY OF THE INVENTION

The present invention relates to an improved accordion-like file, comprising a cover and envelopes for containing papers and documents. One end of the cover corrugates inward and forms a set of folded pieces and block pieces thereon; between each folded piece and block piece is provided a foldable mechanism. The other side of the block piece is provided a set of envelopes forming a rectangular body by moving the block piece outward and adhering it to the folded piece with reusable tape thereon. Therefore, the present invention provides an improved accordion-like file that has a larger space for holding documents upright and that can be carried conveniently.

Accordingly, it is an object of this invention to provide an improved plastic accordion-like file taking advantage of having more space for holding documents.

A further object of this invention is to provide an improved plastic accordion-like file which can stand upright for containing documents conveniently while being portable.

Further objects and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
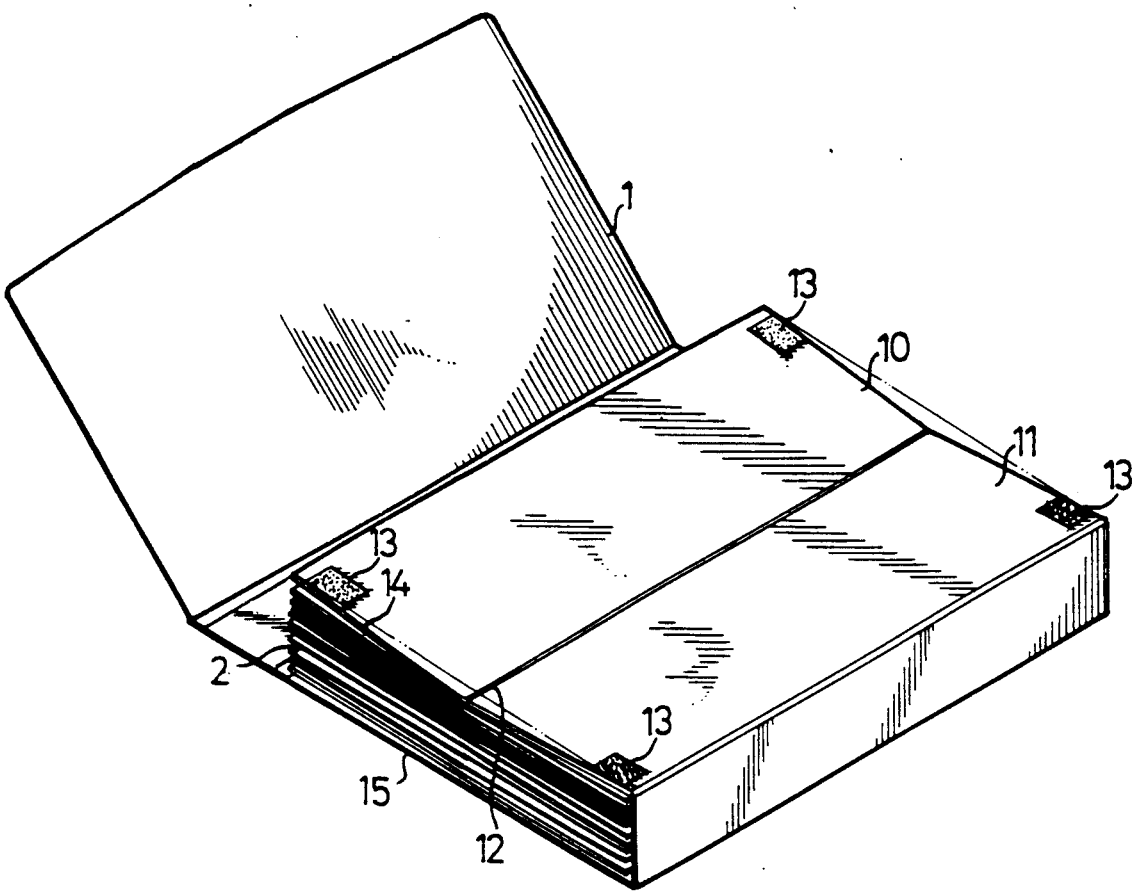
FIG. 1 is a perspective view of an improved accordion-like file in accordance with the present invention.
Figure 2:
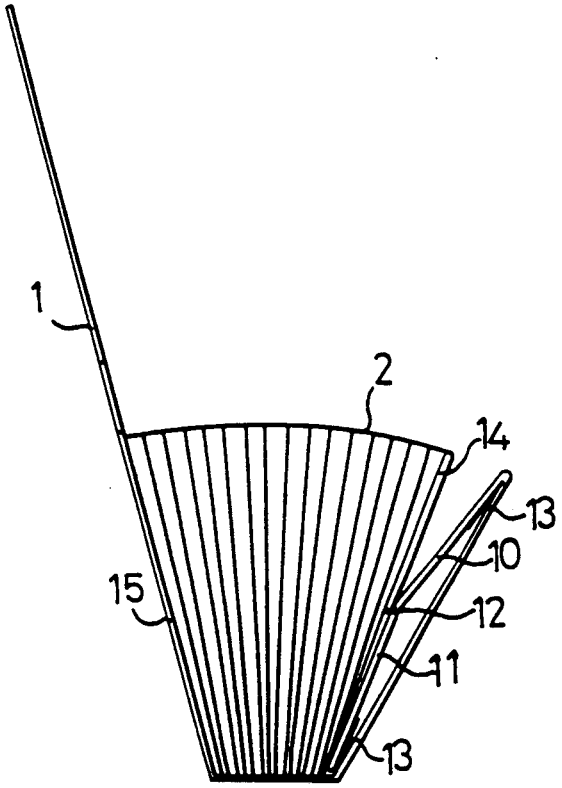
FIG. 2 is a side view of FIG. 1 in a first partial unfolded state.
Figure 3:
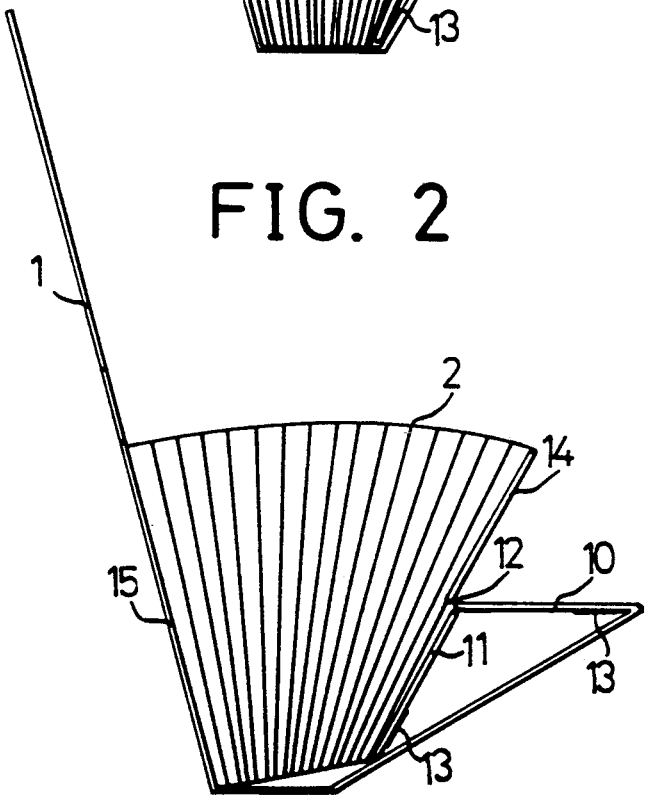
FIG. 3 is a side view of FIG. 1 in a second partial unfolded state.

In reference to FIGS. 1, 2 and 3, the present invention comprises a cover 1 and envelopes 2, wherein the cover 1 has a foldable multiple-sectioned piece formed integrally therein. The cover 1 is characterized in a folded piece 10 and a block piece 11 folded inward at one end thereof with a foldable mechanism 12 provided therebetween. Two sets of reusable tapes 13 are counter provided on the folded piece 10 and the block piece 11 such that the reusable tape 13 stick together when the two pieces 10 and 11 are unfolded. A first end of the envelopes 2 is secured to the block piece 11 at a lower part thereof, and a second end of the envelopes 2 is secured to the cover 1 at an adhesion area 15. A bottom surface of the envelopes 2 is not secured to the cover 1 and can separate therefrom. A second block 14 is provided on an upper part of the first end of the envelopes 2 to support the documents from falling out when the envelopes 2 are folded.

Figure 4:
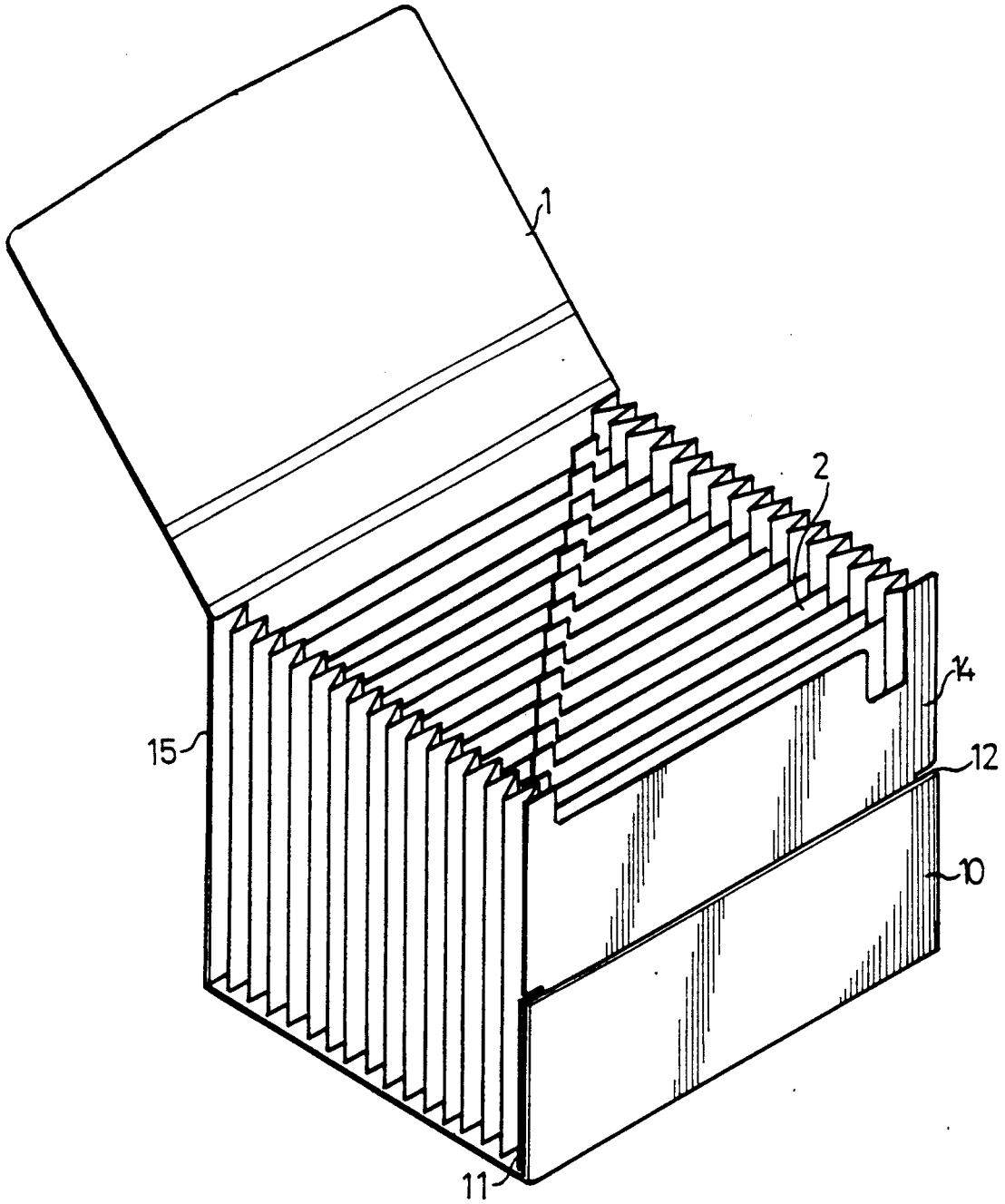
FIG. 4 is a perspective view of FIG. 1 in a unfolded state.
Figure 5:
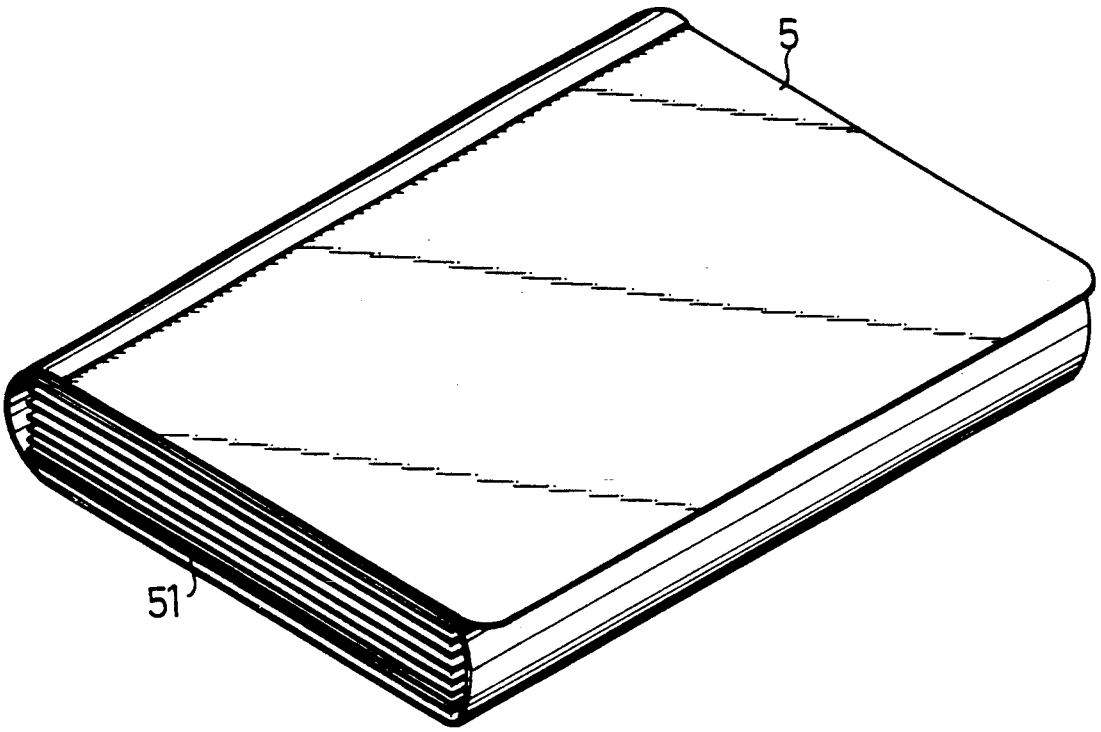
FIG. 5 PRIOR ART
FIG. 5 is a perspective view of a prior accordion-like file.
Figure 6:
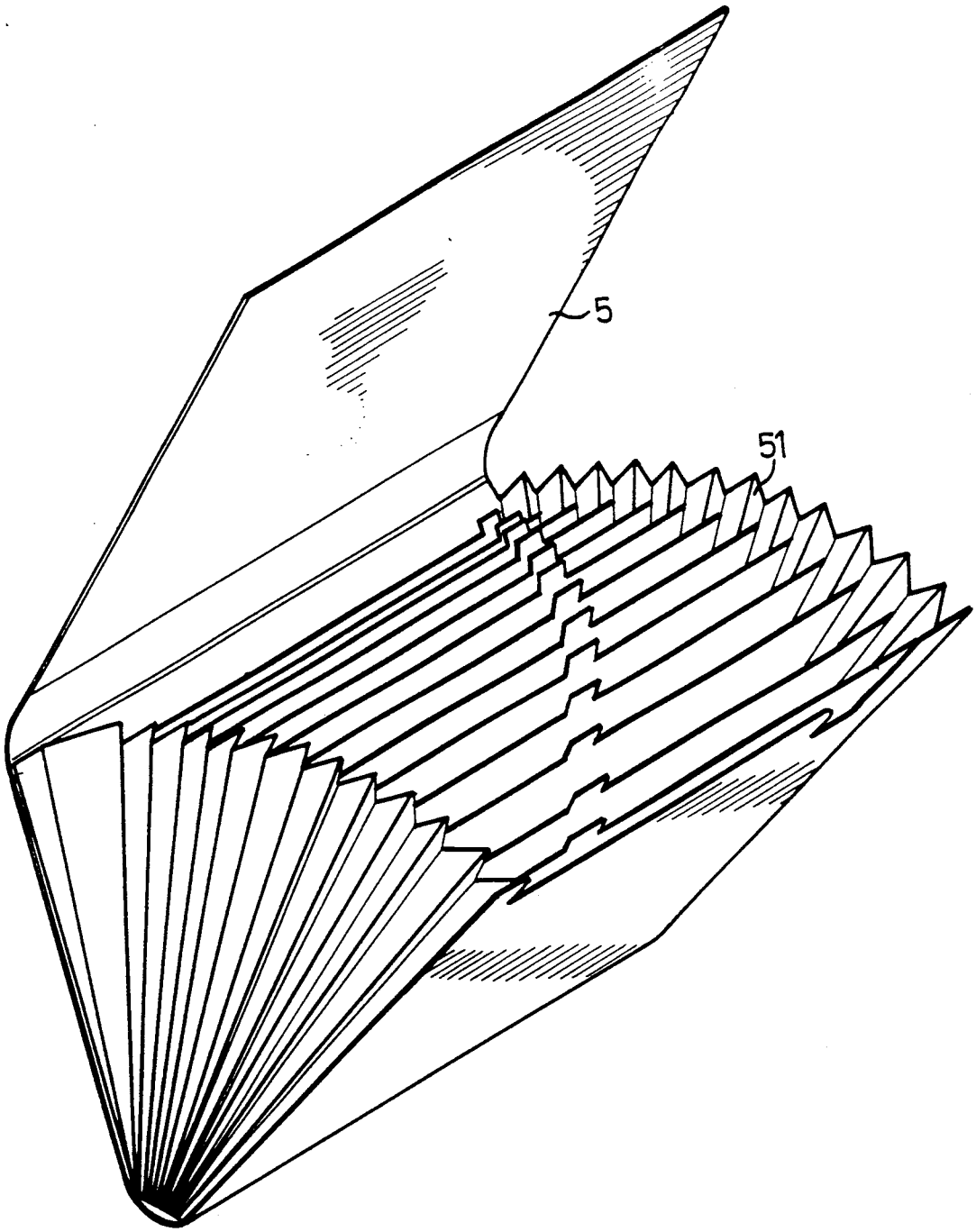
FIG. 6 PRIOR ART
FIG. 6 is a perspective view of the prior accordion-like file of FIG. 5 in a partial unfolded state.

The folded file of the present invention is as easily portable as any conventional file because the block piece 11 and the folded piece 10 are completely contained within the cover 1. In another case, when the file is unfolded as shown in FIG. 4, the present file can completely extend the bottom surface thereof by moving the block piece 11 outward. (Refer to FIGS. 2 and 3). The foldable mechanism 12 allows the folded piece 10 and block piece 11 to pivot relative to each other, eventually becoming flush with the reusable tape 13 thereon adhered together, to form a larger space for holding documents while at the same time forming a solid base with the cover 1.

Accordingly, the present invention provides an improved accordion-like file characterized in the improved structure of cover 1 and association with the envelopes 2, resulting in the following advantages at the lowest manufacturing cost and the same current manufacturing process:

(1) The present file can be unfolded with the cover 1 (between the adhesion area 15 and the folded piece 10) evenly provided below the completely extended envelopes 2 so as to increase the bottom surface and retain a solid stand;

(2) The storage volume of the unfolded file, after extending the envelopes 2, is substantially larger than the folded file;

(3) After putting documents into the envelopes 2, the folded piece 10 can be easily separated from the block piece 11 and folded together with the envelopes 2 to form an original folded file; and (4) The folded piece 10 and the block piece 11 are integrally formed with the cover 1 to save on stocking space, therefore not increasing the manufacturing cost.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. An improved accordion-like file comprising a cover and envelopes, wherein said cover and said envelopes are integrally formed as a foldable multiple-sectioned cover, characterized in:

one end of said cover is folded inward to form a folded piece and a block piece with a foldable mechanism provided therebetween; a bottom end of said block piece is secured to said envelopes such that to extend said envelopes, said block piece is moved outward to be secured to said folded piece.

2. An improved accordion-like file according to claim 1, wherein said folded piece and said block piece are provided with a set of reusable tape for adhesion between said folded piece and said block piece in an unfolded condition.

3. An improved accordion-like file according to claim 1, wherein said envelopes are provided a block at an upper outer portion thereof to block documents from falling out of said envelopes.

* * * * *